US009010904B2

(12) United States Patent
Nukui et al.

(10) Patent No.: US 9,010,904 B2
(45) Date of Patent: Apr. 21, 2015

(54) LIQUID EJECTION APPARATUS

(75) Inventors: Kosuke Nukui, Nagoya (JP); Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 182 days.

(21) Appl. No.: 13/356,531

(22) Filed: Jan. 23, 2012

(65) Prior Publication Data

US 2012/0206537 A1 Aug. 16, 2012

(30) Foreign Application Priority Data

Feb. 10, 2011 (JP) ..... 2011-027085

(51) Int. Cl.
*B41J 2/165* (2006.01)

(52) U.S. Cl.
CPC ..... *B41J 2/165* (2013.01); *B41J 2/16505* (2013.01)

(58) Field of Classification Search
None
See application file for complete search history.

(56) References Cited

U.S. PATENT DOCUMENTS

| | | | | |
|---|---|---|---|---|
| 6,151,043 | A | 11/2000 | Michael et al. | |
| 6,203,136 | B1 | 3/2001 | Takahashi et al. | |
| 6,290,323 | B1 * | 9/2001 | Sharma et al. | 347/28 |
| 6,312,092 | B1 | 11/2001 | Usui et al. | |
| 7,806,517 | B2 | 10/2010 | Muraoka | |
| 8,272,708 | B2 | 9/2012 | Silverbrook et al. | |
| 2007/0206047 | A1 | 9/2007 | Matsuda | |
| 2007/0229581 | A1 | 10/2007 | Taira et al. | |
| 2007/0229611 | A1 | 10/2007 | Nagashima | |
| 2007/0257957 | A1 | 11/2007 | Takagi | |
| 2008/0284814 | A1 | 11/2008 | Chikamoto et al. | |
| 2011/0242204 | A1 * | 10/2011 | Shinoda | 347/29 |
| 2012/0206537 | A1 | 8/2012 | Nukui et al. | |

FOREIGN PATENT DOCUMENTS

| | | | |
|---|---|---|---|
| EP | 2371549 | A1 | 10/2011 |
| GB | 2280149 | A | 1/1995 |
| JP | S64-005852 | A | 1/1989 |
| JP | H02-192951 | A | 7/1990 |
| JP | H03-184852 | A | 8/1991 |

(Continued)

OTHER PUBLICATIONS

European Patent Office, extended European Search Report for European Patent Application No. 12151356.8 (counterpart to above-captioned patent application), dated May 18, 2012.

(Continued)

*Primary Examiner* — Alejandro Valencia
(74) *Attorney, Agent, or Firm* — Baker Botts L.L.P.

(57) ABSTRACT

A capping mechanism, which causes an ejection space opposing ejection openings of a liquid ejection head to take either one of a sealed state and a non-sealed state, includes an annular component which surrounds the ejection space in the sealed state and an opposing member which opposes the ejection openings with the ejection space interposed therebetween. A mechanism for supplying humidified air generates humidified air and includes a supply opening and a discharging opening. The supply opening and the discharging opening are positioned to form a humidifying passage such that the humidified air having flown along an inner circumferential surface of a first region of the annular component passes through a gap between the ejection openings and the opposing member and flows along an inner circumferential surface of a second region of the annular component, which opposes the first region.

10 Claims, 11 Drawing Sheets

(56) References Cited

FOREIGN PATENT DOCUMENTS

| | | | |
|---|---|---|---|
| JP | H09-085959 | A | 3/1997 |
| JP | H10-264402 | A | 10/1998 |
| JP | 2000-079696 | A | 3/2000 |
| JP | 2002-127440 | A | 5/2002 |
| JP | 2003-165230 | A | 6/2003 |
| JP | 2005-212138 | A | 8/2005 |
| JP | 2005-271314 | A | 10/2005 |
| JP | 2007-230137 | A | 9/2007 |
| JP | 2008-030357 | A | 2/2008 |
| JP | 2011-207091 | A | 10/2011 |
| JP | 2012-166368 | A | 9/2012 |

OTHER PUBLICATIONS

European Patent Office, extended European Search Report for European Patent Application No. 11000955.2 (counterpart to above-captioned patent application), dated Aug. 11, 2011.

Japan Patent Office, Notification of Reasons for Refusal for Japanese Patent Application No. 2007-077747 (counterpart Japanese patent application), dispatched Jul. 24, 2012.

Japan Patent Office, Decision of Refusal for Japanese Patent Application No. 2010-077747 (counterpart Japanese patent application), dispatched Oct. 16, 2012.

The State Intellectual Property Office of the People's Republic of China, Notification of First Office Action for Chinese Patent Application No. 201110048527.8 (counterpart Chinese patent application), issued Apr. 3, 2013.

United States Patent and Trademark Office, Non Final Office Action for U.S. Appl. No. 13/851,022 (related to above-captioned patent application), mailed Jul. 18, 2014.

United States Patent and Trademark Office, Non Final Office Action for U.S. Appl. No. 14/016,043 (related to above-captioned patent application), mailed Oct. 3, 2014.

* cited by examiner

LIQUID EJECTION APPARATUS

CROSS REFERENCE TO RELATED APPLICATION

The present application claims priority from Japanese Patent Application No. 2011-27085, which was filed on Feb. 10, 2011, the disclosure of which is herein incorporated by reference in its entirety.

BACKGROUND OF THE INVENTION

1. Field of the Invention

The present invention relates to a liquid ejection apparatus which ejects liquid through ejection openings to record an image on a recording medium.

2. Description of the Related Art

A liquid ejection apparatus includes a head having an ejection surface on which ejection openings through which liquid such as ink is ejected are formed. When no liquid is ejected through the ejection opening for a long period, the moisture of the liquid around the ejection openings is evaporated and hence the viscosity is increased, with the result that the ejection openings are clogged.

The technology to restrain the clogging of the ejection openings is arranged so that an ejection space separated from the external space is formed by entirely covering the ejection surface by a concave capping member. According to the technology, by an air conditioner having an airflow passage provided with an air supply opening and an air discharging opening both made through the bottom surface of the capping member, humidified air is supplied into the ejection space through the air supply opening and the air in the ejection space is discharged through the air discharging opening. As such, the liquid around the ejection openings is humidified. The evaporation of the liquid around the ejection openings is restrained in this manner, and hence the clogging of the ejection openings is restrained.

SUMMARY OF THE INVENTION

The above-described technology, however, is arranged so that the air supply opening and the air discharging opening are not formed at the respective edges of the bottom surface of the capping member. That is to say, in the ejection space is provided a humidifying passage in which humidified air flows from the air supply opening to the air discharging opening via the ejection surface. Since this passage does not reach the edges of the capping member, it is not possible to humidify, by the humidified air, the liquid adhering to an annular component which is a part of the capping member and abuts against the ejection surface. For this reason, once the circulation of the humidified air is stopped, thickened liquid which is not humidified and piles up on the annular component and its vicinity absorbs moisture from the liquid around the ejection openings, with the result that the liquid around the ejection openings are thickened and the ejection openings are clogged.

An object of the present invention is to provide a liquid ejection apparatus in which the thickening of liquid piling up on an annular component and its vicinity is restrained.

A liquid ejection apparatus of the present invention includes: a liquid ejection head having ejection openings for ejecting liquid; a capping mechanism which causes an ejection space opposing the ejection openings to take either one of a sealed state in which the ejection space is separated from an external space and a non-sealed state in which the ejection space is connected to the external space, the capping mechanism including an annular component which surrounds the ejection space in the sealed state and an opposing member which opposes the ejection openings with the ejection space interposed therebetween; a mechanism for supplying humidified air, which generates humidified air and includes a supply opening through which the humidified air is supplied into the ejection space separated from the external space by the capping mechanism and a discharging opening through which air is discharged from the ejection space; and a control unit which controls the capping mechanism so that the ejection space takes either one of the sealed state and the non-sealed state and controls the mechanism for supplying humidified air so that the humidified air is supplied to the ejection space in the sealed state through the supply opening and the humidified air is discharged through the discharging opening, the supply opening and the discharging opening being positioned to form a humidifying passage such that the humidified air having flown along an inner circumferential surface of a first region of the annular component passes through a gap between the ejection openings and the opposing member and flows along an inner circumferential surface of a second region of the annular component, which opposes the first region.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
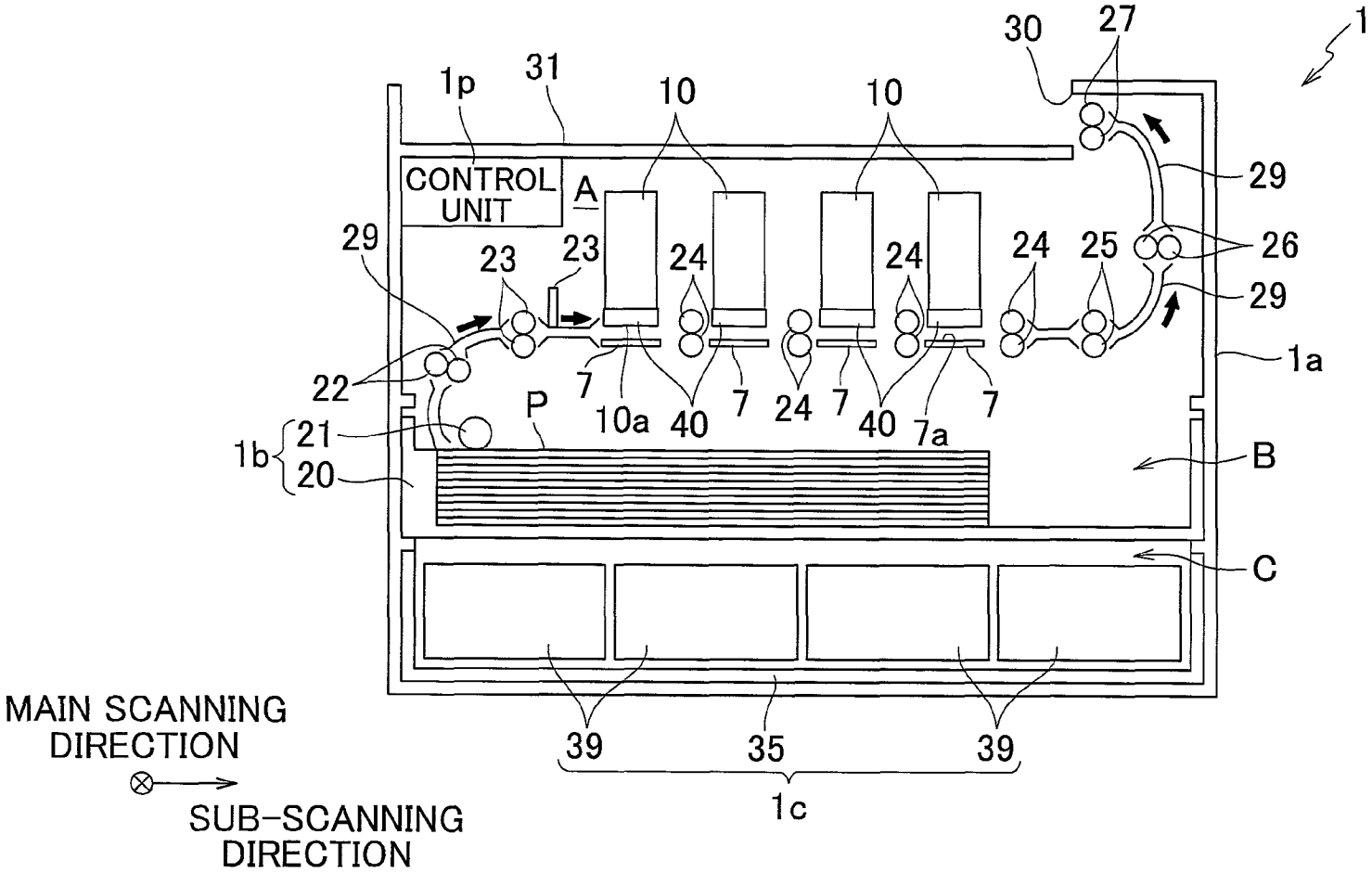
FIG. 1 is a schematic profile of the internal structure of an inkjet printer which is an embodiment of the liquid ejection apparatus of the present invention.

Referring to FIG. 1, the overall configuration of an inkjet printer 1 which is an embodiment of the liquid ejection apparatus of the present invention will be described.

The printer 1 has a rectangular parallelepiped chassis 1*a*. On the top plate of the chassis 1*a* is provided a sheet discharge section 31. The internal space of the chassis 1*a* is divided into spaces A, B, and C sequentially from the top. The spaces A and B have therein a sheet conveyance passage connecting a sheet supply unit 1*b* with the sheet discharge section 31. In the space A, image formation on a sheet P and transportation of the sheet P to the sheet discharge section 31 are carried out. In the space B, the sheet P is supplied to the conveying passage. In the space C, ink is supplied to heads 10 in the space A.

In the space A are provided components such as a sheet sensor 32, four heads 10, a transportation unit, guide units 29 which guide sheets P, a mechanism 50 for supplying humidified air (see FIG. 5) used for humidifying maintenance, and a control unit 1*p*. The transportation unit is constituted by four flat platens 7 opposing the four heads 10, respectively, and four feed roller pairs 24 provided along the sheet conveyance passage, and transports a sheet P in the direction indicated by thick arrows in FIG. 1 (i.e., in a conveyance direction).

Each head 10 is substantially rectangular parallelepiped and is long in the main scanning direction. The heads 10 are aligned in the sub-scanning direction at predetermined intervals, and are supported by the chassis 1*a* via head holders 3 (see FIG. 5). The head holders 3 support the heads 10 so that a predetermined gap suitable for recording is formed between an ejection surface 10*a* which is the lower surface of each head 10 and an opposing surface 7*a* which is the upper surface of the platen 7. The head holders 3 are provided with, for the respective heads 10, caps 40 which are annular components and disposed around the lower ends of the heads 10. Each cap 40 encloses the head 10 therein in plan view and surrounds the ejection surface 10*a*. The configuration, operation, function or the like of the caps 40 will be discussed later.

The guide units 29 are provided to sandwich the transportation unit. The guide unit 29 on the upstream in the conveyance direction includes a guide and two feed roller pairs 22 and 23, and connects a sheet supply unit 1*b* (described later) with the transportation unit. A sheet P for image formation is transported toward the transportation unit. The guide unit 29 on the downstream has a guide and three feed roller pairs 25 to 27, and connects the transportation unit with the sheet discharge section 31. The sheet P after image formation is transported toward the sheet discharge section 31.

In the space B is provided the sheet supply unit 1*b*. The sheet supply unit 1*b* includes a sheet feeding tray 20 and a pickup roller 21. The sheet feeding tray 20 is arranged to be detachable to the chassis 1*a*. The sheet feeding tray 20 is an open-top box and capable of housing a plurality of sheets P therein. The pickup roller 21 sends out the topmost sheet P housed in the sheet feeding tray 20. A sub-scanning direction is in parallel to the sheet conveyance direction in which sheets are transported by the feed roller pairs 23 and 24, whereas a main scanning direction is in parallel to the horizontal plane and orthogonal to the sub-scanning direction.

In the space C is provided a cartridge unit 1*c* which is arranged to be detachable to the chassis 1*a*. The cartridge unit 1*c* has a tray 35 and four cartridges 39 aligned in the tray 35. The four cartridges 39 store magenta, cyan, yellow, and black inks, respectively. Each cartridge 39 is connected to a head 10 via an unillustrated tube to supply ink having the corresponding color to the head 10.

Now, the control unit 1*p* will be described. The control unit 1*p* controls the components of the printer 1 and the overall operation of the printer 1. The control unit 1*p* controls an image formation operation based on image data supplied from an external apparatus (e.g., a PC connected to the printer 1). More specifically, the control unit 1*p* controls a preparation operation concerning recording, operations of supplying, transporting, and discharging sheets P, an ink ejection operation in sync with the transportation of sheets P, or the like. Furthermore, the control unit 1*p* controls the maintenance operation for the heads 10.

The control unit 1*p* drives, based on a recording instruction supplied from the external apparatus, a pickup motor 125 (see FIG. 8) for the pickup roller 21, a feed motor 127 (see FIG. 8) for the feed roller pairs 22 to 27, or the like. A sheet P sent out from the sheet feeding tray 20 is guided by the upstream guide unit 29 and sent to the transportation unit. In the transportation unit, the sheet P is transported while being supported by the opposing surfaces 7*a* of the platens 7 one by one. When the sheet P moves in the sub-scanning direction (sheet conveyance direction) and reaches the position immediately below each head 10, ink is ejected from the ejection surface 10*a* under the control of the control unit 1*p*, with the result that a color image is formed on the sheet P. The ink discharging operation is conducted based on a detection signal output from a sheet sensor 32 which detects the leading end of the sheet P. The sheet P on which the image has been formed is guided by the downstream guide unit 29, and is then discharged to the sheet discharge section 31 through an opening 30 made through an upper portion of the chassis 1*a*.

The control unit 1*p* conducts the maintenance operation to recover or maintain the ink ejection property of the head 10 and to carry out preparation for recording. The maintenance operation includes an ink ejection operation by purging and flushing, a cleaning operation to clean the ejection surface 10*a* by wiping, and a thickening prevention operation to prevent ink from being thickened by capping and humidification.

Figure 10:
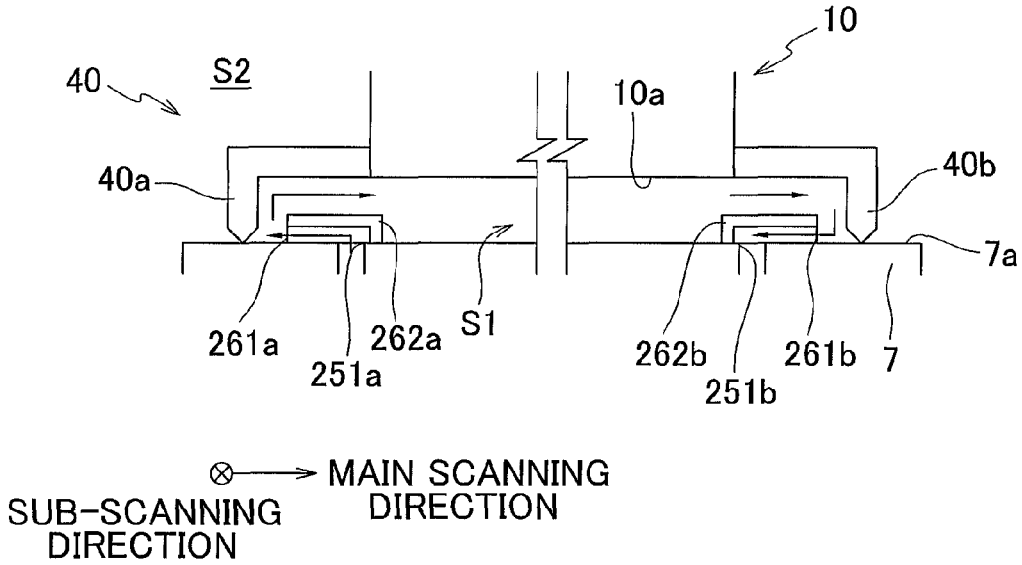
FIG. 10 is a schematic view concerning the first variation of the liquid ejection apparatus of the embodiment of the present invention, showing the humidifying maintenance operation carried out in the sealed state.
Figure 11:
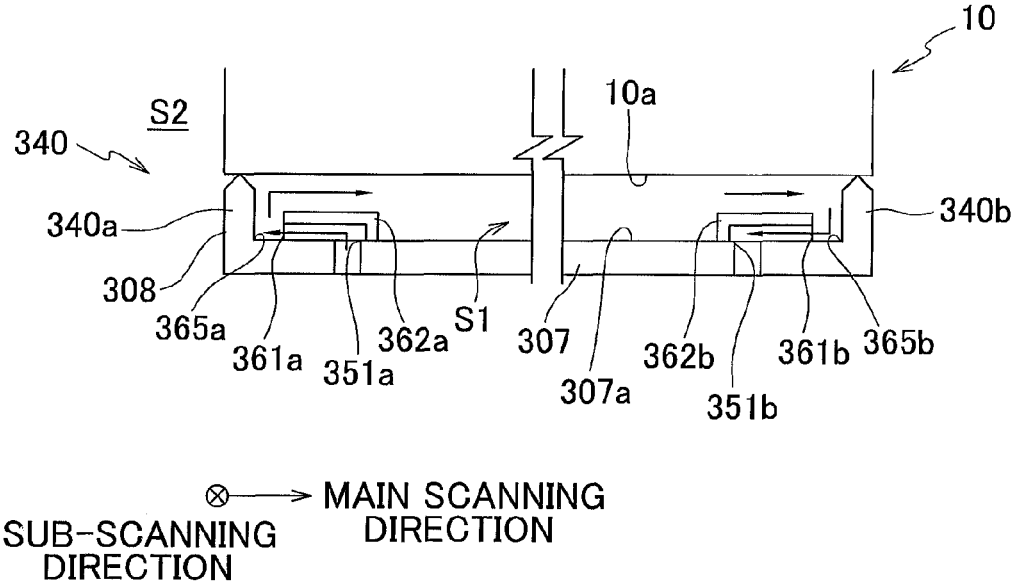
FIG. 11 is a schematic view concerning the second variation of the liquid ejection apparatus of the embodiment of the present invention, showing the humidifying maintenance operation carried out in the sealed state.
Figure 12:
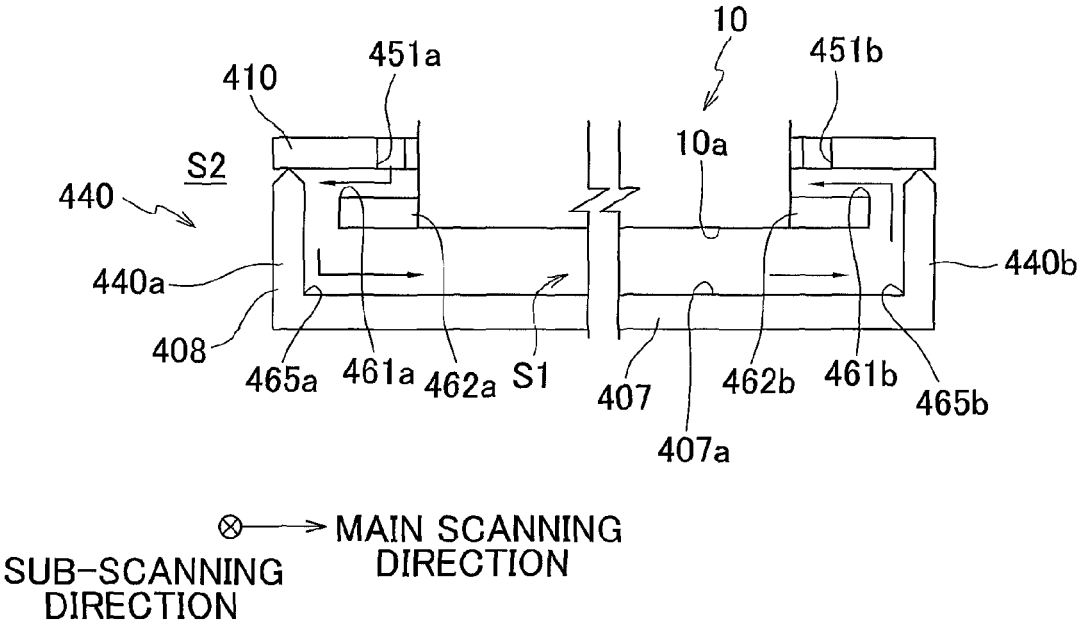
FIG. 12 is a schematic view concerning the third variation of the liquid ejection apparatus of the embodiment of the present invention, showing the humidifying maintenance operation carried out in the sealed state.

In the purging, a pump is driven so that ink is forcibly ejected through all ejection openings 14*a*. In the flushing, an actuator is driven so that ink is ejected through all ejection openings 14*a*. The ink ejection is conducted based on flushing data which is different from the image data. In the wiping, the ejection surface 10*a* is wiped by a wiper blade which is a plate-shaped elastic member. The wiping is conducted after the ink ejection operation, to remove residual ink and foreign matters on the ejection surface 10*a*. In the capping, as shown in FIG. 6B, the cap 40 separates the ejection space S1 opposing the ejection surface 10*a* from the external space S2. In the humidifying maintenance in the thickening prevention operation, as shown in FIGS. 10 to 12 in addition to FIG. 6B, humidified air is supplied to the separated ejection space S1.

The ink ejection operation is accompanied with the cleaning operation, and foreign matters in the head 10 and the thickened ink around the ejection openings 14*a* are ejected. The ejection surface 10*a* is cleaned as the ejection property of the ejection openings 14*a* is recovered. The capping restrains the drying of the meniscus, and the drying is further restrained by humidification. This ink ejection operation is conducted, for example, immediately after turning on the power of the printer 1, at the time of paper jam on the conveying passage, after image formation continued for at least a predetermined time, or after non-ejection for at least a predetermined time. The ink ejection operation (flushing in particular) immediately after turning on the power source is a preparation operation related to the recording. The operation to prevent ink from being thickened is conducted when the printer 1 is stopped or on standby.

Figure 2:
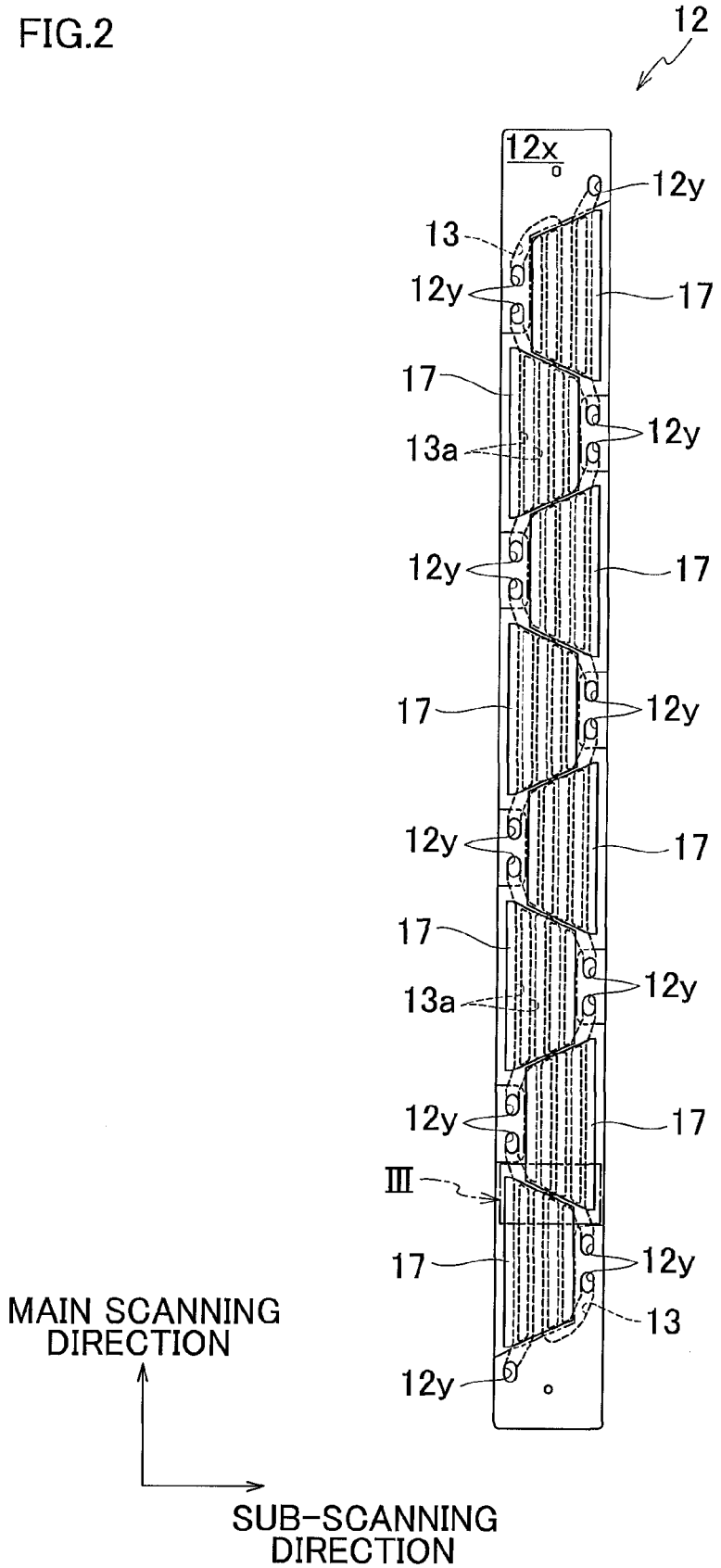
FIG. 2 is a plan view showing a passage unit and an actuator unit in the inkjet head of the printer of FIG. 1.
Figure 3:
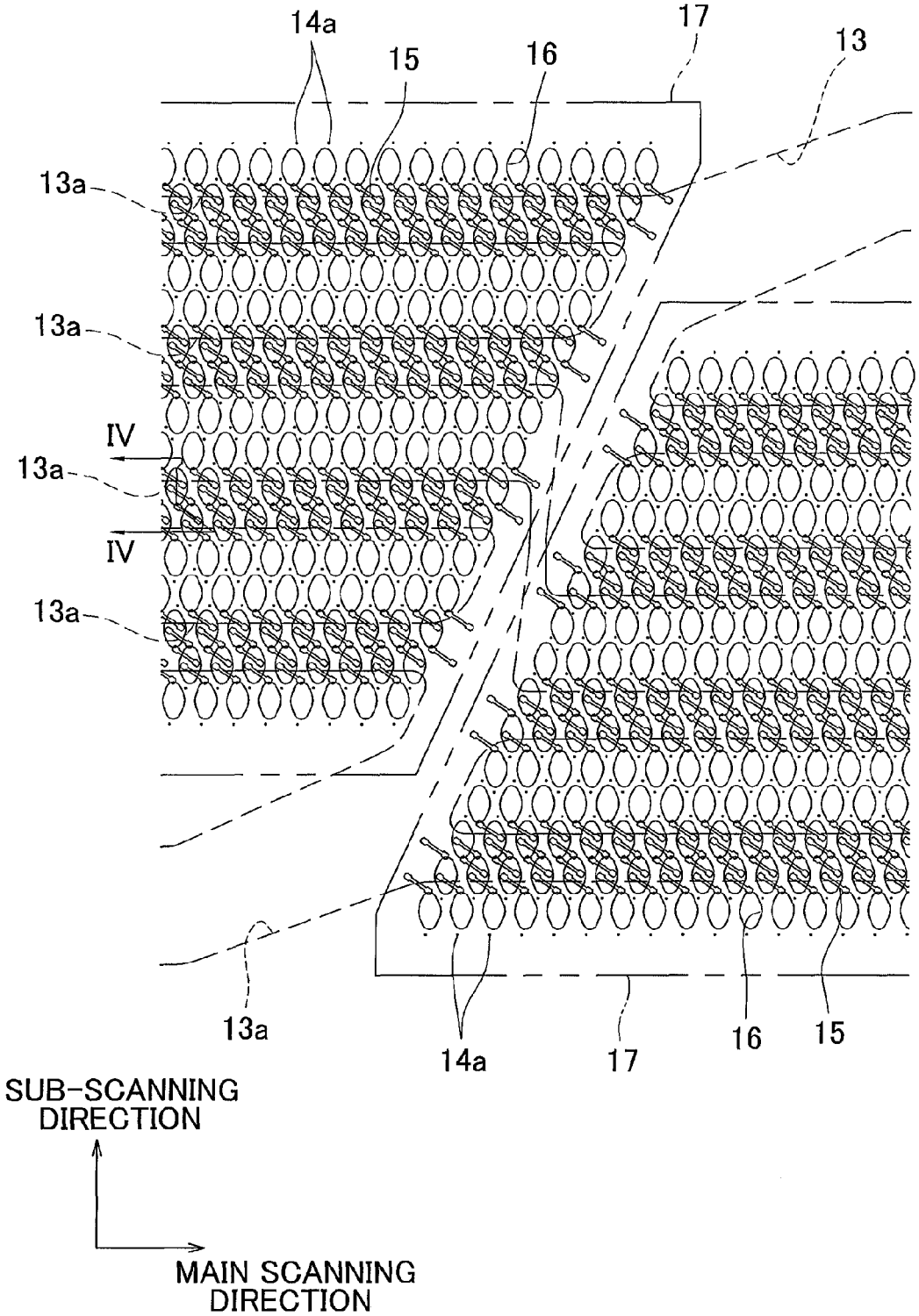
FIG. 3 is an enlarged view of the region III which is enclosed by a dashed line in FIG. 2.

Now, referring to FIG. 2 to FIG. 5, the arrangement of each head 10 will be described. In FIG. 3, the pressure chamber 16 and the aperture 15 are indicated by full lines rather than broken lines, even if they are provided below the actuator unit 17.

Figure 4:
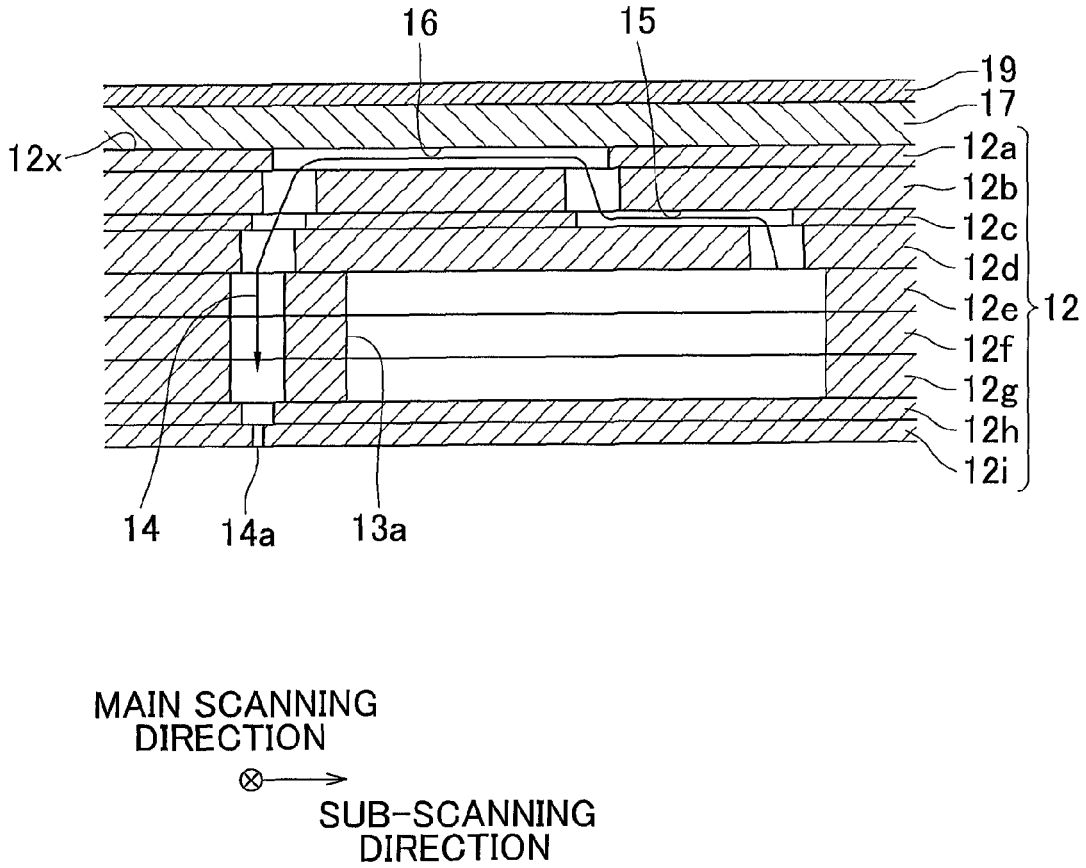
FIG. 4 is a partial cross section of FIG. 3 taken along the IV-IV line.

The head 10 is formed by depositing a passage unit 12, actuator units 17, a reservoir unit 11, and a circuit board from bottom up. The reservoir unit 11 as an upstream passage member has an upstream ink passage including a reservoir, which receives ink from the cartridge 39. The reservoir temporarily stores ink. The passage unit 12 as a downstream passage member is, as shown in FIG. 4, formed by depositing nine rectangular metal plates 12*a*-12*i*. The passage unit 12 has a downstream ink passage. This downstream ink passage is connected with the upstream ink passage at an opening 12*y* on the upper surface 12*x*. The downstream ink passage is constituted by, as shown in FIG. 2 to FIG. 4, a manifold passage 13 whose one end is the opening 12*y*, a sub-manifold passage 13*a* branched from the manifold passage 13, and a plurality of individual ink flow passages 14 connected to the sub-manifold passage 13*a*. Each individual ink flow passage 14 has an aperture 15 for adjusting the passage resistance, and connects the outlet of the sub-manifold passage 13*a* with the ejection opening 14*a* via the pressure chamber 16. Through the upper surface 12*x*, pressure chambers 16 are made in a matrix manner. The lower surface is an ejection surface 10*a* where the ejection openings 14*a* are formed.

The actuator units 17 are sandwiched between the reservoir unit 11 and the passage unit 12 and are provided in a staggered manner along the main scanning direction. The actuator units 17 are fixed at the upper surface 12*x* of the passage unit 12 to seal the opening of each pressure chamber 16. The actuator units 17 are formed by depositing a piezoelectric layer (topmost layer) polarized in the thickness directions onto a diaphragm. The diaphragm is also a piezoelectric layer but does not actively deform. The topmost layer is sandwiched by a plurality of individual electrodes on the surface and a common electrode on the inner side. As a part sandwiched between one individual electrode and the common electrode is deformed, this part and the diaphragm conduct unimorph deformation. The part conducting the unimorph deformation (i.e., the part sandwiched between the individual electrode and the pressure chamber) functions as an individual actuator, and such actuators are selectively driven by a drive signal.

The circuit board is electrically connected to the actuator units 17 by an FPC 19. The FPC 19 is mounted with a driver IC on its part. Under the control of the control unit 1*p*, the FPC 19 transmits various signals (such as a control signal and an image signal) relayed and adjusted by the circuit board to the driver IC, and transmits a drive signal generated by the driver IC to an individual actuator.

Figure 5:
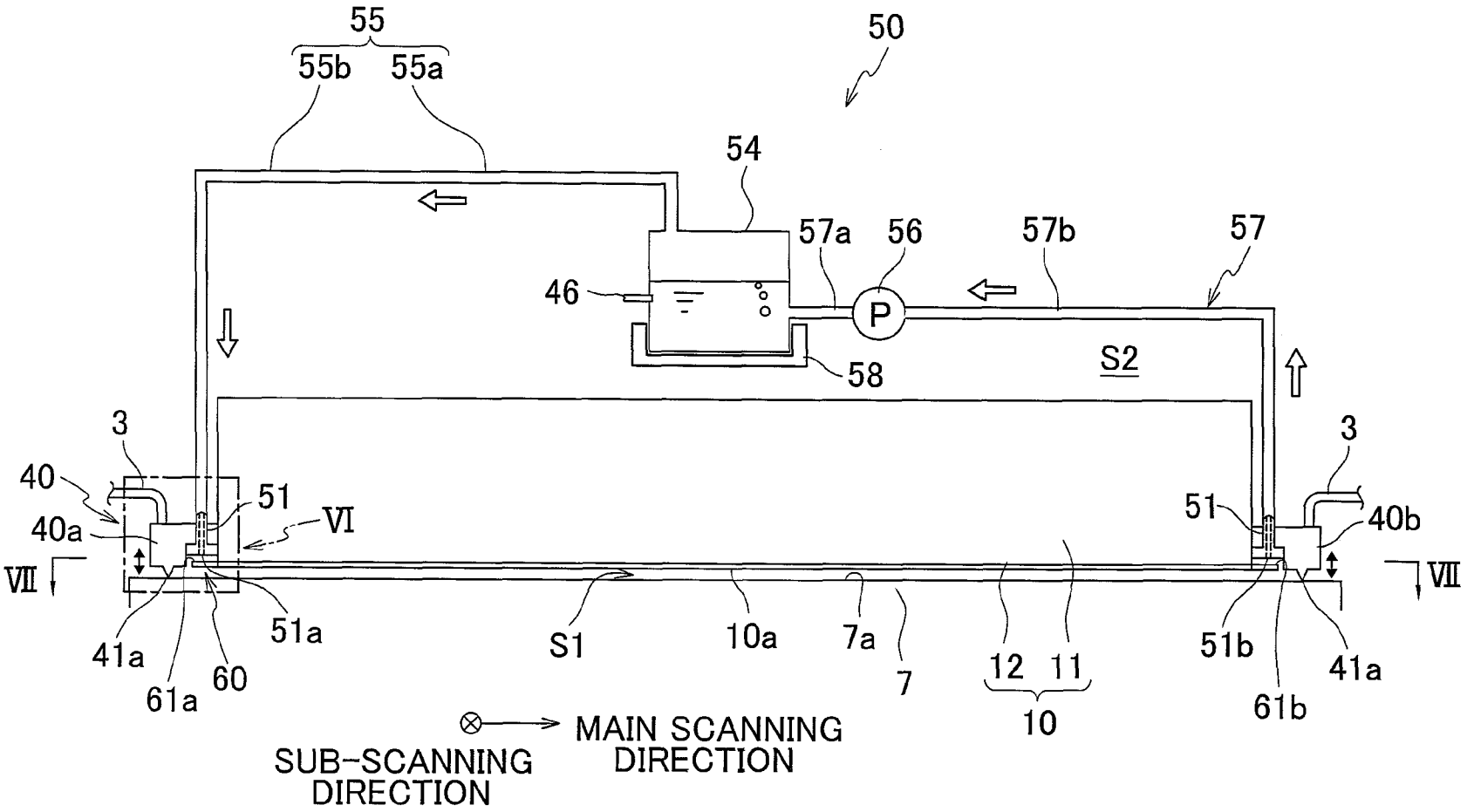
FIG. 5 is a schematic view showing a head holder and a mechanism for supplying humidified air in the printer of FIG. 1.
Figure 6A:
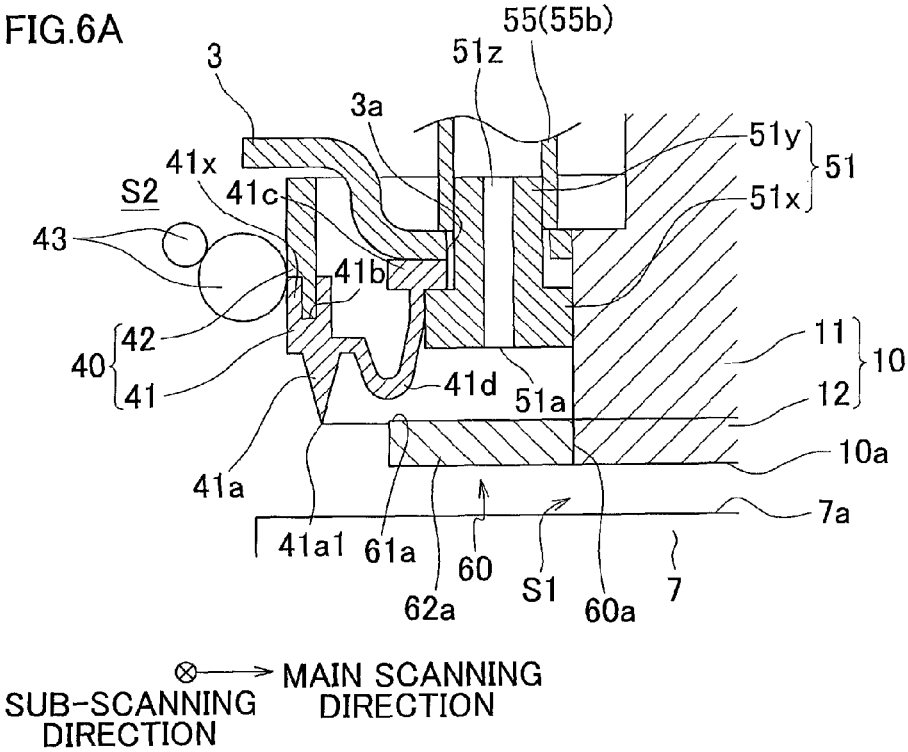
FIG. 6A is a partial cross section of the region VI enclosed by a dashed line in FIG. 5, showing a state in which the cap is at a separated position.
Figure 6B:
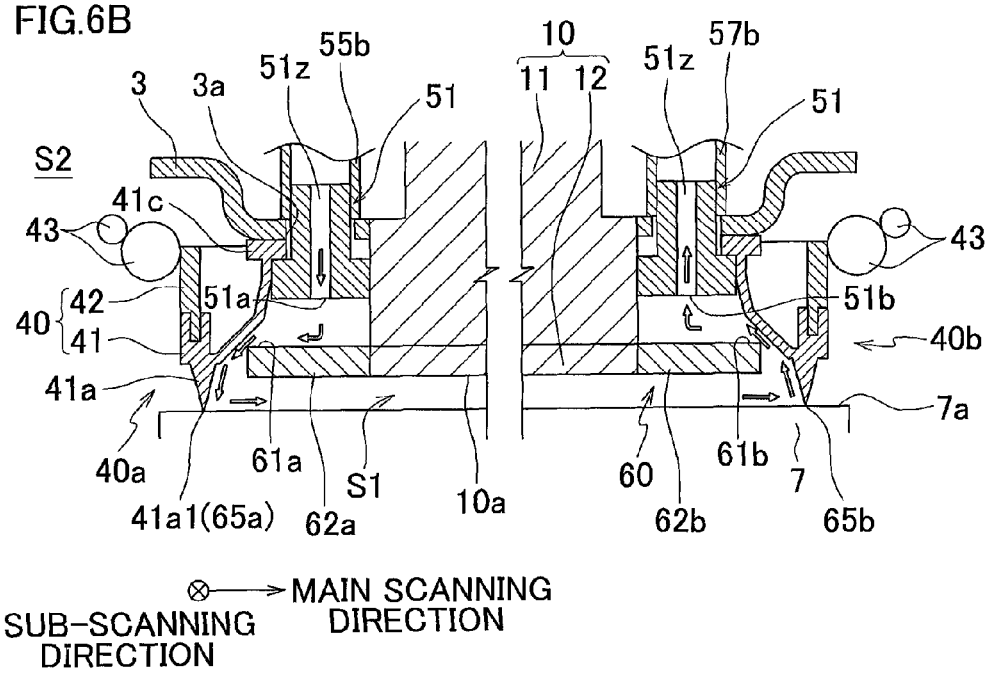
FIG. 6B is also a partial cross section of the region VI, showing a state in which the cap is at an abutting position.
Figure 7:
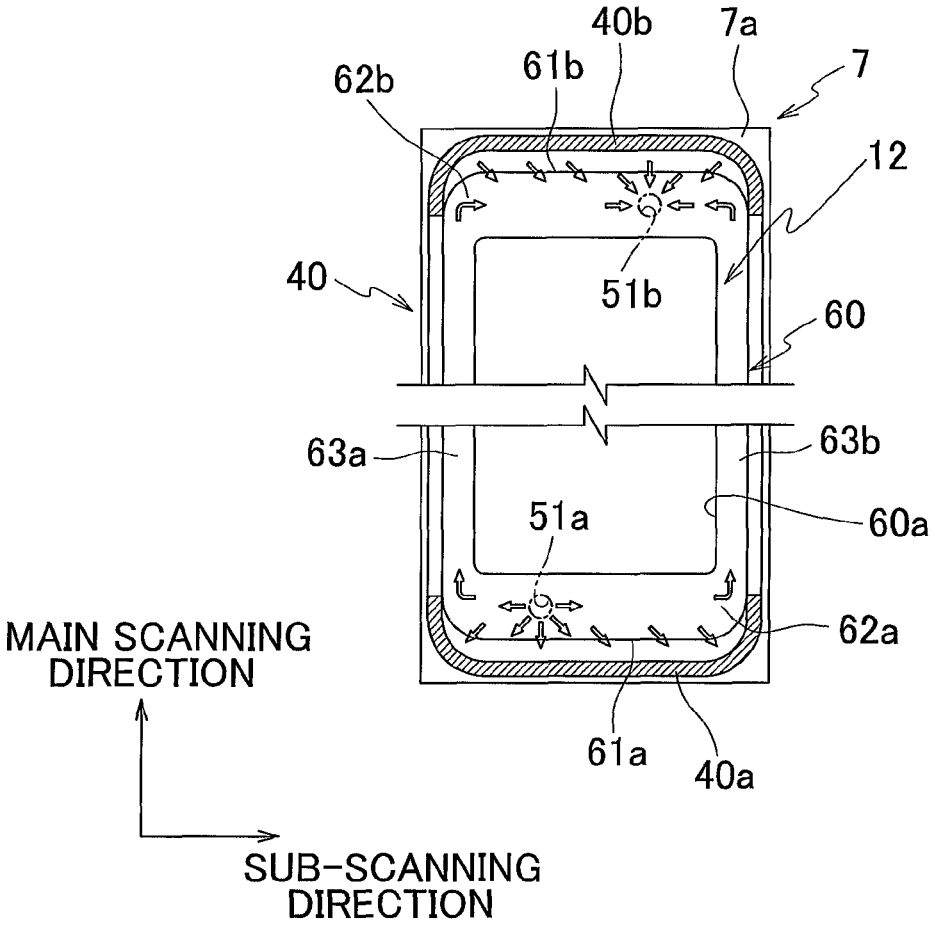
FIG. 7 is a cross section of FIG. 5 taken along the VII-VII line.

Now, referring to FIG. 5 to FIG. 7, a head holder 3 and a cap 40 and joints 51 attached to the head holder 3 will described.

The head holder 3 is a frame made of metal, which supports the entirety of the side faces of the reservoir unit 11. The head holder 3 is provided for each head 10 and provided with a cap 40 and a pair of joints 51. The pair of joints 51 are, as show in FIG. 5, provided to be adjacent to the respective end portions of the head 10 in the main scanning direction. More specifically, as shown in FIG. 5, the pair of joints 51 are constituted by a left joint 51 having an opening 51*a* and a right joint 51 having an opening 51*b*, and these joints 51 are provided to sandwich the reservoir unit 11 in the main scanning direction. The pair of joints 51 are provided to be point symmetric about the center of the head 10. In the humidifying maintenance, humidified air is supplied to the ejection space S1 from the opening 51*a*, and air is discharged through the opening 51*b*. The openings 51*a* and 51*b* are, as shown in FIG. 5, provided at locations further from the opposing surface 7*a* than the ejection surface 10*a*.

The joint 51 has, as shown in FIG. 6A, a square-shaped proximal end portion 51*x* and a cylindrical leading end portion 51*y* extending from the proximal end portion 51*x*. In the joint 51, a cylindrical hollow space 51*z* is formed so as to extend in the vertical directions from the proximal end portion 51*x* to the leading end portion 51*y*. The exterior size of the proximal end portion 51*x* is larger than that of the leading end portion 51*y*. The hollow space 51*z* is equally sized in cross section along the vertical directions. The proximal end portion 51*x* is long in the sub-scanning direction, and the width (length) in the longitudinal directions thereof is slightly longer than the ejection surface 10*a* and substantially as long as a pair of horizontal portions 62*a* and 62*b*.

The head holder 3 has a through hole 3*a* which is circular in plan view, and the joint 51 is fixed to the head holder 3 as the leading end portion 51*y* is inserted into the through hole 3*a*. The leading end portion 51*y* is a size smaller than the through hole 3*a*. The gap therebetween is sealed by a sealing material or the like.

Each cap 40 is, as shown in FIG. 7, a rectangular annular component surrounding the outer circumference of the head 10 in plan view, and is long in the main scanning direction. The cap 40 includes, as shown in FIG. 6A, an elastic member 41 supported by the head holder 3 and an elevatable movable body 42. Furthermore, the cap 40 defines, as shown in FIG. 5 and FIG. 6B, parts of a supply opening 61*a* and a discharging opening 61*b*.

The elastic member 41 is made of an annular elastic material such as rubber, and surrounds the head 10 in plan view. The elastic member 41 includes, as shown in FIG. 6A, a base portion 41*x*, a protrusion 41*a* protruding downward from the base portion 41*x*, a fixing component 41*c* fixed to the head holder 3, and a connecting portion 41*d* connecting the base portion 41*x* with the fixing component 41*c*. Among these components, the protrusion 41*a* protrudes from the lower surface of the base portion 41*x* and is triangular in vertical cross section. The fixing component 41*c* is T-shaped in cross section. The upper end of the fixing component 41*c* is fixed to the head holder 3 by an adhesive or the like. The fixing component 41*c* is sandwiched between the head holder 3 and the proximal end portion 51*x* of each joint 51. The connecting portion 41*d* curvedly extends from the lower end of the fixing component 41*c* toward the outside (i.e. in the direction away from the ejection surface 10*a* in plan view) and is connected to the lower end of the base portion 41*x*. The connecting portion 41*d* is deformed in accordance with the vertical movement of the movable body 42. When lowered, the connecting portion 41*d* defines the supply opening 61*a* with a later-described horizontal portion 62*a*, and constitutes the discharging opening 61*b* with a later-described horizontal portion 62*b*. On the upper surface of the base portion 41*x* is formed a concave portion 41*b*. This concave portion 41*b* is fitted with the lower end of the movable body 42.

The movable body 42 is made of an annular rigid material (such as stainless steel) and surrounds the outer circumference of the head 10 in plan view. The movable body 42 is supported by the head holder 3 via the elastic member 41 and is arranged to be movable relative to the head holder 3 in the vertical directions. The movable body 42 is connected with a plurality of gears 43 at a plurality of parts. As an elevating motor 44 (see FIG. 8) is driven under the control of the control unit 1*p*, the gears 43 rotate and the movable body 42 moves up or down. The base portion 41*x* also moves up or down with the movable body 42. As a result, the relative positions of the leading end 41*a*1 of the protrusion 41*a* and the ejection surface 10*a* are changed in the vertical directions. In the present embodiment, the driving force of the one elevating motor 44 is selectively transmitted to the plurality of gears 43 corresponding to the four caps 40, for one of the caps 40.

As the movable body 42 moves up or down, the protrusion 41*a* selectively takes either a abutting position (shown in FIG. 6B) where the leading end 41*a*1 abuts against the opposing surface 7*a* or a separated position (see FIG. 6A) where the leading end 41*a*1 is away from the opposing surface 7*a*. At the abutting position, the ejection space S1 is in a sealed state in which the ejection space S1 is sandwiched between the ejection surface 10*a* and the opposing surface 7*a* of the platen 7 so as to be separated from the external space S2. On the other hand, at the separated position, the ejection space S1 is in a non-sealed state in which the ejection space S1 is connected to the external space S2. According to the present embodiment, the caps 40 which are annular components, the transmission mechanism including the gears 43, the head holder 3, the elevating motor 44, and the platen 7 which is an opposing component constitute the capping mechanism.

Now, referring to FIG. 5 to FIG. 7, the structure of the mechanism 50 for supplying humidified air will be described.

The mechanism 50 for supplying humidified air includes, as shown in FIG. 5, a pair of joints 51, a guide member 60, tubes 55 and 57, a pump 56, a water temperature sensor 46, a heater 58, and a tank 54. Each of the tubes 55 and 57 includes main bodies 55*a* and 57*a* which are shared by the four heads 10 and four branches 55*b* and 57*b* branched from the main bodies 55*a* and 57*a* and reach the joints 51. The pump 56 is provided on the main body 57*a*. FIG. 5 shows a pair of branches 55*b* and 57*b* and a single head 10. In actual cases, however, four heads 10 are connected in a parallel manner with a single main body 55*a* and a single main body 57*a* via the branches 55*b* and 57*b*.

The leading end of the branch 55*b* of the tube 55 is fitted with the leading end portion 51*y* of the left joint 51, whereas the other end of the each branch 55*b* is connected to the tank 54.

On the other hand, the leading end of the branch 57*b* of the tube 57 is fitted with the leading end 51*y* of the right joint 51, whereas the other end of the branch 57*b* is connected to the tank 54.

The tank 54 stores water in its lower space, and also stores, in its upper space, humidified air humidified by the water in the lower space. The tube 57 is connected to the lower space of the tank 54. On the other hand, the tube 55 is connected to the upper space of the tank 54. To prevent the water in the tank 54 from flowing into the pump 56, an unillustrated check valve is attached to the tube 57 to allow the air to flow only in the direction indicated by outlined arrows in FIG. 5. Furthermore, the tank 54 is provided with the water temperature sensor 46 measuring the temperature of the water, and the heater 58 is provided in the vicinity of the tank 54 (lower space) to heat the water in the tank 54. To perform the humidification, the heater 58 is controlled by the control unit 1*p* based on the result of temperature detection by the water temperature sensor 46, so that the moisture of the humidified air is adjusted. In the present embodiment, the power source of the printer 1 is turned on so that the moisture of the humidified air is automatically adjusted to a desired moisture. When the remaining amount of water in the tank 54 becomes small, water is supplied from an unillustrated supply tank.

As described above, the present embodiment is arranged so that a humidification device for generating humidified air is constituted by components such as a tank 54, a heater 58, and a water temperature sensor 46. Furthermore, a return passage of humidified air is formed by components such as tubes 55 and 57 and a pair of joints 51 in addition to a cap 40 establishing the sealed state. Thanks to the humidification device and the return passage, it is possible to effectively humidify the ejection space S1 during the humidifying maintenance.

In the present embodiment, as shown in FIG. 6B and FIG. 7, a guide member 60 having a lower surface which is flush with the ejection surface 10*a* and continued from the ejection surface 10*a* is provided to surround the head 10. The guide member 60 is a rectangular plate member having a through hole at the center. With this through hole, the lower end and its vicinity of the head 10 is fitted. The guide member 60 is constituted by a pair of horizontal portions 62*a* and 62*b* extending in the sub-scanning direction and a pair of horizontal portions 63*a* and 63*b* extending in the main scanning direction, and the inner circumferential surface 60*a* of the through hole is bonded with the profile of the passage unit 12. The horizontal portion 62*a* which is a first guide is provided to oppose the opening 51*a* of the left joint 51 and defines the supply opening 61*a* with the connecting portion 41*d* of the cap 40. The horizontal portion 62*b* which is a second guide is provided to oppose the opening 51*b* of the right joint 51 and defines the discharging opening 61*b* with the connecting portion 41*d*.

The pair of horizontal portions 62*a* and 62*b* are connected to the respective ends of the head 10 in the main scanning direction so as to be adjacent to each other. On the other hand, the pair of the horizontal portions 63*a* and 63*b* are connected to the respective ends of the head 10 in the sub-scanning direction so as to be adjacent to each other, so that the pair of the horizontal portions 62*a* and 62*b* are connected thereby with each other. Furthermore, the pair of the horizontal portions 63*a* and 63*b* are substantially as long as the ejection surface 10*a* in the main scanning direction. The pair of horizontal portions 62*a* and 62*b* are formed to be slightly longer than the ejection surface 10*a* and substantially as long as the proximal end portion 51*x* in the sub-scanning direction.

The horizontal portion 62*a* which is the first guide is, as shown in FIG. 6B, arranged so that the outer upper corner portions thereof in the main scanning direction oppose the inner circumferential surface of the connecting portion 41*d* extending obliquely downward, with a gap therebetween. This gap extends to reach the both end portions of the horizontal portion 62*a* in the sub-scanning direction, so as to define the supply opening 61*a*. At these end portions, the inner circumferential surface of the connecting portion 41*d* contacts the corner portions of the horizontal portion 62*a*. The humidified air flows out from the entirety of the long and narrow supply opening 61*a*. The supply opening 61*a* is arranged to be open toward the first region 40*a* of the cap 40. The first region 40*a* is constituted by the connecting portion 41*d* and the protrusion 41*a*, and is a region defined by one short side of the rectangular elastic member 41 and a corner connecting this short side and a long side. The lower shaded region in FIG. 7 is provided around the lower edge of the first region 40*a*. Because the supply opening 61*a* is open toward the first region 40*a* in this manner, the humidified air certainly flows along the inner circumferential surface of the first region 40*a* as indicated by outlined arrows in FIG. 6B.

By the arrangement above, the present embodiment is arranged so that, when the ejection space S1 is in the sealed state, a humidifying passage is formed so that the humidified air flows along the inner circumferential surfaces of the first region 40*a* and the second region 40*b* of the cap 40. This makes it possible to restrain the ink remaining on the cap 40 and its surrounding from being thickened. As a result, the ink in the ejection opening 14*a* is not easily thickened in the sealed state. Furthermore, since the supply opening 61*a* is open toward the first region 40*a*, the humidified air supplied from the supply opening 61*a* is encouraged to flow along the entirety of the inner circumferential surface of the first region 40*a* of the cap 40. This further restrains the residual ink adhering to the inner circumferential surface from being thickened.

The arrangement around the horizontal portion 62*b* which is the second guide is, as shown in FIG. 6B, identical with the arrangement around the horizontal portion 62*a*. The discharging opening 61*b* discharges air around the inner circumferential surface of the second region 40*b* (the upper shaded region in FIG. 7 is provided around the lower edge of the second region 40*b*) defined by the protrusion 41*a* and the connecting portion 41*d*. Because the discharging opening 61*b* is provided to be adjacent to the second region 40*b* as above, the air inside the ejection space S1 certainly flows along the inner circumferential surface of the second region 40*b* as indicated by outline arrows in FIG. 6B. In other words, the air inside the ejection space S1 is encouraged to flow along the entirety of the inner circumferential surface of the second region 40*b* of the cap 40. It is therefore possible to further restrain the residual ink adhering to the inner circumferential surface from being thickened.

According to the present embodiment, the supply opening 61*a* and the discharging opening 61*b* are arranged to circumferentially extend along the inner circumferential surfaces of the first region 40*a* and the second region 40*b*, respectively. It is therefore possible to further restrain the residual ink from being thickened.

In addition to the above, according to the present embodiment, the head 10 and the cap 40 are, in plan view, rectangular and the lengths thereof in the main scanning direction are longer than the lengths thereof in the sub-scanning direction, and one short side of the cap 40 is a part of the first region 40*a* whereas the other short side of the cap 40 is a part of the second region 40*b*. This further restrains the residual ink from being thickened.

According to the arrangement above, when the humidifying maintenance is conducted, the pump 56 is driven under the control of the control unit 1*p* so that the humidified air in the tank 54 flows from the tank 54 toward the opening 51*a* (i.e. in the direction indicated by the outlined arrow in FIG. 5), and hence the humidified air is circulated in the ejection space S1. In other words, as indicated by the outlined arrows in FIG. 6B and FIG. 7, the humidified air flowing vertically downward from the opening 51*a* collides with the upper surface of the horizontal portion 62*a* so as to generate a flow along the upper surface, and is further supplied from the supply opening 61*a* to the ejection space S1 along the connecting portion 41*d* which is a part of the first region 40*a*. Thereafter, the humidified air flows toward the second region 40*b* as the air passes through the gap between the ejection surface 10*a* having the plurality of ejection openings 14*a* and the opposing surface 7*a* and the gap between the pair of horizontal portions 63*a* and 63*b* and the opposing surface 7*a*. At the same time, a part of the humidified air flows above the pair of horizontal portions 63*a* and 63*b* and is discharged through the opening 51*b*. It is therefore possible to humidify the residual ink remaining on this passage.

The humidified air having flown toward the second region 40*b* flows along the inner circumferential surface of the second region 40*b* and is discharged through the discharging opening 61*b*. The discharged air passes through the opening 51*b* and the tube 57 and flows into the tank 54.

According to the present embodiment, as shown in FIG. 6B, the humidifying passage includes a passage which extends along a first boundary 65*a* which is the boundary between the first region 40*a* of the cap 40 and the platen 7 and a second boundary 65*b* which is the boundary between the second region 40*b* and the platen 7. Furthermore, the humidifying passage includes a passage which connects the first region 40*a* and the second region 40*b* of the cap 40 with each other and extends along the boundary between a region of the cap 40 which region is in parallel to the main scanning direction and the platen 7 (i.e., the portion where the region abuts against the platen 7). In short, all boundaries are parts of the humidifying passage. Since the humidifying maintenance is conducted in this way, a humidifying passage is constructed so that the humidified air flows into every corner of the ejection space 51 and is eventually discharged through the discharging opening 61*b*. It is noted that, once ink adheres to any part of the leading end 41*a*1 of the cap 40, the ink spreads along the boundaries including the first and second boundaries 65*a* and 65*b*. In this regard, since the humidifying passage includes passages extending along these boundaries, the humidified air supplies moisture to the ink at the boundaries. As such, the thickening of the ink is restrained at the ejection openings 14*a* adjacent to the boundaries.

Now, referring to FIG. 8, the electric configuration of the printer 1 will be described.

Figure 8:
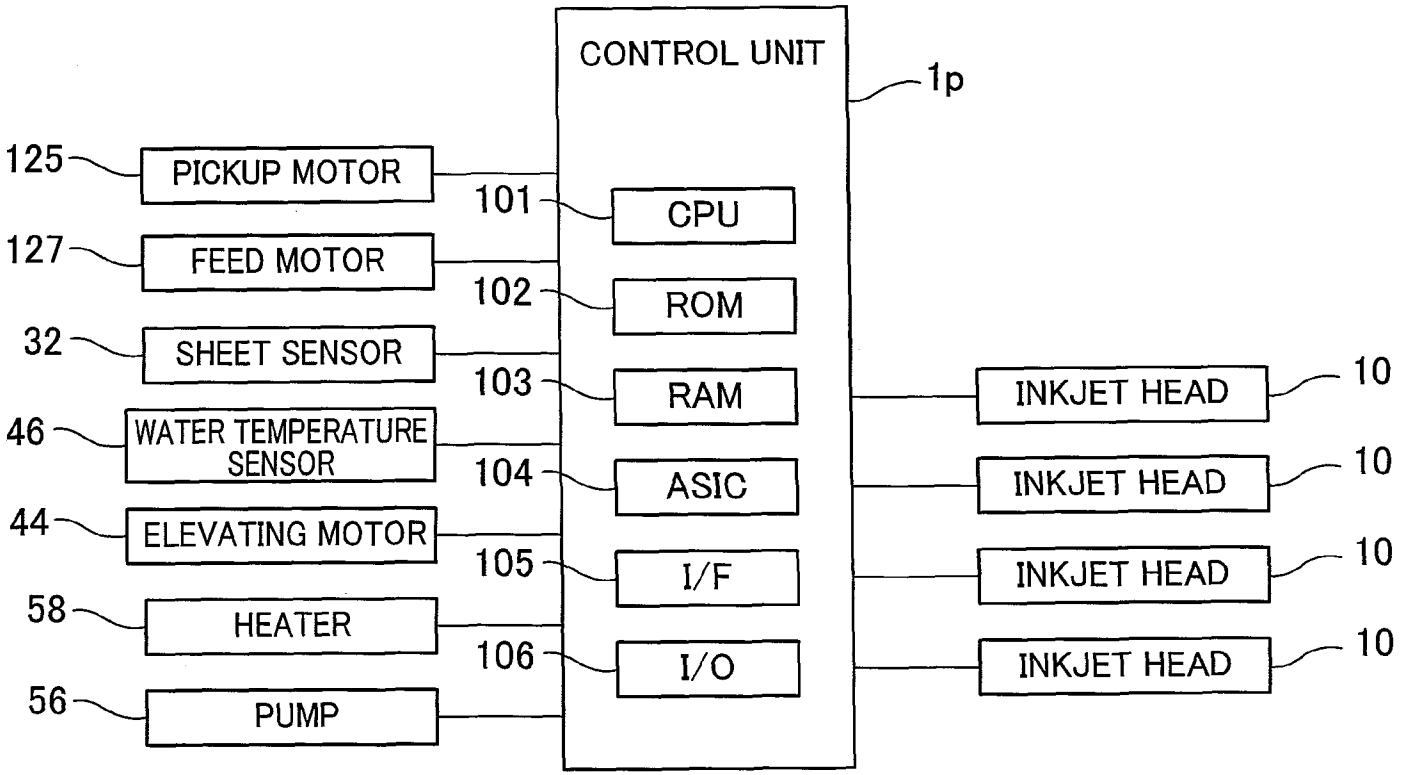
FIG. 8 is a block diagram showing the electric configuration of the printer.

As shown in FIG. 8, the control unit 1*p* includes, in addition to a CPU (Central Processing Unit) 101 which is a processing unit, a ROM (Read Only Memory) 102, a RAM (Random Access Memory: including nonvolatile RAM) 103, an ASIC (Application Specific Integrated Circuit) 104, an I/F (Interface) 105, and an I/O (Input/Output Port) 106. The ROM 102 stores programs run by the CPU 101, various types of fixed data, or the like. The RAM 103 temporarily stores data required when a program is run. The ASIC 104 conducts rewriting, reordering (e.g., signal processing and image processing) or the like of image data. The I/F 105 deals with data exchange with an external apparatus. The I/O 106 inputs or outputs detection signals to/from sensors.

The control unit 1*p* is connected to motors 125 and 127, a sheet sensor 32, a control substrate of the head 10, a water temperature sensor 46, a heater 58, a pump 56, or the like. The control unit 1*p* is also connected to an elevating motor 44 which drives the gears 43 (see FIG. 6A).

Figure 9:
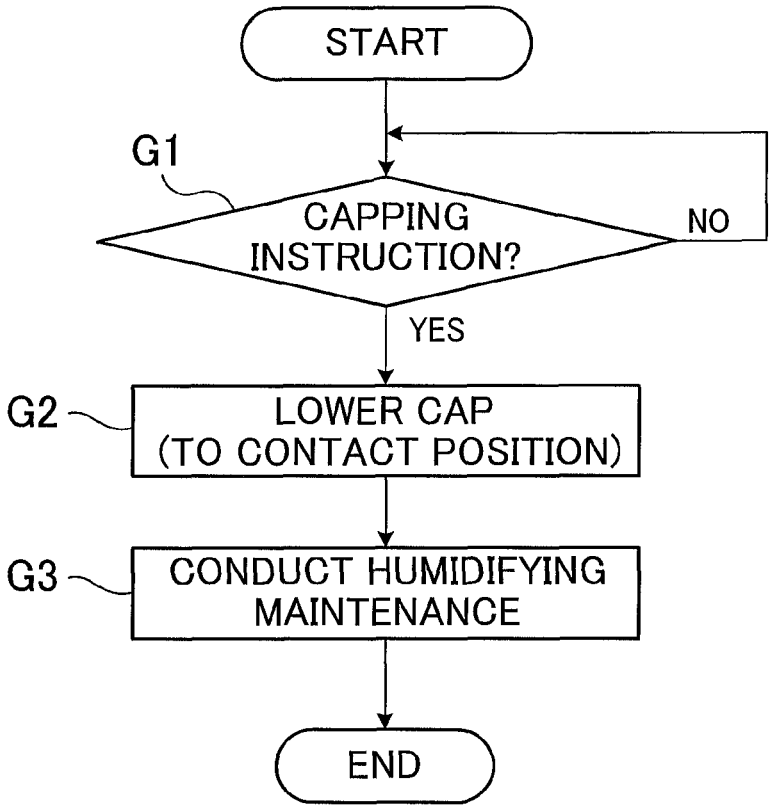
FIG. 9 is a flowchart of capping and humidifying maintenance operations controlled by a control unit of the printer.

Now, referring to FIG. 9, how the control unit 1*p* controls the capping and the humidifying maintenance will be detailed.

First, the control unit 1*p* determines, as shown in FIG. 9, whether a capping instruction has been received (G1). Before receiving the capping instruction, the cap 40 is at the separated position.

Receiving the capping instruction (G1: YES), the control unit 1*p* drives the elevating motor 44 so as to move each cap 40 from the separated position to the abutting position (G2). As a result, the leading end 41*a*1 of each cap 40 abuts against the opposing surface 7*a* and hence the ejection space 51 formed between the ejection surface 10*a* and the opposing surface 7*a* of the platen 7 becomes in the sealed state and separated from the external space S2 (see FIG. 5 and FIG. 6B).

After the step G2, the control unit 1*p* drives the pump 56 to conduct the humidifying maintenance of supplying the humidified air in the tank 54 from the supply opening 61*a* to the ejection space 51 and discharging the air in the ejection space 51 through the discharging opening 61*b*, for a predetermined time (G3). With this, the humidified air circulates between the tank 54 and the ejection space 51, with the result that the moisture of the air in the ejection space 51 is adjusted to a desired moisture. In so doing, the humidified air supplied from the supply opening 61*a* flows along the humidifying passage in the ejection space 51 as described above, and is discharged through the discharging opening 61*b*. It is therefore possible to supply the moisture to the residual ink and the ink around the ejection openings 14*a* on the humidifying passage.

As such, the capping and the humidifying maintenance are completed. Thereafter, receiving a signal such as the recording instruction from an external apparatus, the control unit 1*p* drives the elevating motor 44 so as to move each cap 40 from the abutting position to the separated position. Consequently, the leading end 41*a*1 of each cap 40 is separated from the opposing surface 7*a* and a non-sealed state is established, so that the ejection space 51 formed between the ejection surface 10*a* and the opposing surface 7*a* of the platen 7 is connected to the external space S2 (see FIG. 1). Thereafter, the recording operation is conducted under the control of the control unit 1*p* as described above.

As described above, the printer 1 of the present embodiment is arranged so that, in the humidifying maintenance, the humidified air flows along the inner circumferential surfaces of the first region 40*a* and the second region 40*b* of the cap 40 which is an annular component. For this reason, even if, for example, ink remains on the cap 40 and its surroundings (e.g. at the boundary between the cap 40 and the platen 7) as a result of the preliminary ejection, it is possible to supply moisture to such residual ink. It is therefore possible to restrain the thickening of the residual ink after the humidifying maintenance has been conducted and the sealed state continues, and therefore the ink in the ejection openings 14*a* is not easily thickened.

In addition to the above, since the pair of horizontal portions 62*a* and 62*b* are provided as first and second guides to constitute the supply opening 61*a* and the discharging opening 61*b*, the thickening of the ink on the inner circumferential surfaces of the second regions 40*a* and 40*b*, where ink is likely to remain, is certainly prevented.

Now, variations of the embodiment above will be described. According to the first variation, humidified air is supplied from the platen 7 into the ejection space S1. More specifically, as shown in FIG. 10, two openings 251*a* and 251*b* are provided on the platen 7 to sandwich the ejection surface 10*a* in the main scanning direction. The opening 251*a* is connected to the branch 55*b* of the tube 55, and the humidified air is supplied into the ejection space S1 therethrough. On the other hand, the opening 251*b* is connected to the branch 57*b* of the tube 57, and the air in the ejection space S1 is discharged therethrough. To cover the opening 251*a* and the opening 251*b*, respectively, guide members 262*a* and 262*b* are provided to sandwich the sheet conveying passage in the main scanning direction. Each of these guide members 262*a* and 262*b* is L-shaped in cross section and is fixed to the opposing surface 7*a*.

The guide member 262*a* which is the first guide defines the supply opening 261*a* with the opposing surface 7*a* and is open toward the first region 40*a*. With this, the humidified air from the opening 251*a* is also supplied toward the first region 40*a*. The guide member 262*b* as the second guide defines the discharging opening 261*b* with the opposing surface 7*a* and is open toward the second region 40*b*. For this reason, the air in the ejection space S1 flows along the second region 40*b* and then certainly discharged through the discharging opening 261*b*.

Also in this first variation, in the humidifying maintenance, the humidified air supplied from the supply opening 261*a* flows, as shown in an arrow in FIG. 10, along the inner circumferential surface of the first region 40*a*, passes through the gap between the ejection surface 10*a* and the opposing surface 7*a*, flows along the inner circumferential surface of the second region 40*b*, and is discharged through the discharging opening 261*b*. Such a humidifying passage is formed in the ejection space 51. With this, the effects similar to those of the embodiment above are achieved. In the variation, furthermore, each head 10 is not provided with a joint 51 or the like, because the humidified air is supplied and discharged from/through the platen 7.

A second variation described below is arranged so that a capping mechanism different from the above-described capping mechanism is used. In this case, the capping mechanism includes, as shown in FIG. 11, a cap 340 and a moving mechanism (not illustrated) which moves the cap 340 between an opposing position where the cap 340 opposes the ejection surface 10*a* and a non-opposing position where the cap 340 does not oppose the ejection surface 10*a*.

The cap 340 includes a flat-plate-shaped opposing member 307 opposing the ejection surface 10*a* and an annular lip 308 standing on the periphery of the opposing member 307, so as to form a concave portion arranged to be open toward the ejection surface 10*a*. The lip 308 is arranged to oppose the periphery of the ejection surface 10*a* when the cap 340 is at the opposing position. The opposing member 307 is provided with two openings 351*a* and 351*b* which are remote from each other in the main scanning direction. The opening 351*a* is connected to the branch 55*b* of the tube 55 to supply the humidified air in the humidifying maintenance. On the other hand, the opening 351*b* is connected to the branch 57*b* of the tube 57 to discharge the air in the ejection space S1 in the humidifying maintenance. On the upper surface (opposing surface) 307*a* of the opposing member 307 opposing the ejection surface 10*a*, guide members 362*a* and 362*b* are fixed as the first and second guides in the same manner as the first variation, so that the supply opening 361*a* and the discharging opening 361*b* are defined.

The supply opening 361*a* is arranged to be open toward one end portion (i.e., the first region 340*a* which is a part of the lip 308) of the cap 340 in the main scanning direction. The humidified air is therefore supplied toward the first region 340*a*. The discharging opening 361*b* is arranged to be open toward the other end portion (i.e., the second region 340*b* which is a part of the lip 308) of the cap 340 and to be in proximity to the second region 340*b*. It is therefore possible to cause the air in the ejection space S1 to flow along the second region 340*b* and then to be certainly discharged through the discharging opening 361*b*.

The moving mechanism moves up or down the cap 340 when the cap 340 is at the opposing position (i.e., when the cap 340 is at a position between the abutting position where the lip 308 abuts against the ejection surface 10*a* and the separated position where the lip 308 and the ejection surface 10*a* are separated). With this, the capping mechanism causes the ejection space S1 to take either a sealed state where the ejection space S1 is separated from the external space S2 or a non-sealed state where the ejection space S1 is connected to the external space S2. The lip 308 surrounds the ejection space S1 in the sealed state. In this variation, furthermore, a joint 51 or the like is not provided in each head 10 because the humidified air is supplied from and discharged through the opposing member 307.

According to the second variation, the humidified air supplied from the supply opening 361*a* flows, as indicated by arrows in FIG. 11, along the inner circumferential surface of the first region 340*a*. Thereafter, the humidified air flows along the boundary of the ejection surface 10*a* and the lip 308 (i.e., at the leading end of the lip 308) and along the ejection surface 10*a*, passes through the gap between the ejection surface 10*a* where the plurality of ejection openings 14*a* are formed and the opposing surface 307*a*, flows along the inner circumferential surface of the second region 340*b*, and is eventually discharged through the discharging opening 361*b*. In the humidifying maintenance of the variation, such a humidifying passage is formed in the ejection space S1. The effects similar to those of the embodiment above are therefore achieved. Furthermore, the humidifying passage in the humidifying maintenance includes a passage along the boundary between the ejection surface 10*a* and the lip 308. Since the humidified air flows along the boundary where ink is likely to remain, it is possible to supply moisture to the ink at the boundary. The thickening of the residual ink is therefore restrained and the thickening of the ink at the ejection openings 14*a* adjacent to the boundary is also restrained.

In addition to the above, as shown in FIG. 11, the humidifying passage includes a passage extending along the first boundary 365*a* which is a boundary between the first region 340*a* which is a part of the lip 308 of the cap 340 and the opposing member 307 and along the second boundary 365*b* which is a boundary between the second region 340*b* which is a part of the lip 308 and the opposing member 307. Since this makes it possible to supply moisture to the ink remaining at the boundaries 365*a* and 365*b*, it is possible to restrain such residual ink from being thickened. As a matter of course, the effects similar to those of the embodiment above are achieved.

In the second variation, an annular plate-shaped component having a lower surface provided at the same height as the ejection surface 10*a* lower surface may be fixed to the outer side faces of the head 10 to surround the head 10 so that the lower surface of the plate-shaped component abuts against the lip 308. In other words, the lip 308 may be arranged not to abut against the ejection surface 10*a* but to abut against the plate-shaped component on the outer circumference. The effects similar to the above are achievable with this arrangement.

A third variation described below uses a further capping mechanism. In this case, the capping mechanism includes, as shown in FIG. 12, a cap 440 and a moving mechanism (not illustrated) which moves the cap 440 between an opposing position where the cap 440 opposes the ejection surface 10*a* and a non-opposing position where the cap 440 does not oppose the ejection surface 10*a*.

The cap 440 includes a flat-plate-shaped opposing member 407 opposing the ejection surface 10*a* and an annular lip 408 standing on the periphery of the opposing member 407, so as to form a concave portion which is open toward the ejection surface 10*a*. The lip 408 is formed to oppose the periphery of a later-described plate-shaped component 410 when the cap 440 is at the opposing position. The moving mechanism moves up or down the cap 440 when the cap 440 is at the opposing position (i.e., when the cap 440 is at a position between a abutting position where the lip 408 abuts against the plate-shaped component 410 and a separated position where the lip 408 is separated from the plate-shaped component 410). With this, the capping mechanism causes the ejection space S1 to take either a sealed state where the ejection space S1 is separated from the external space S2 or a non-sealed state where the ejection space S1 is connected to the external space S2. The lip 408 surrounds the ejection space S1 in the sealed state.

To the outer profile of the head 10, an annular plate-shaped component 410 is fixed to surround the head 10. The plate-shaped component 410 has two openings 451*a* and 451*b* which are arranged to sandwich the head 10 in the main scanning direction. The opening 451*a* is connected to the branch 55*b* of the tube 55 to supply humidified air in the humidifying maintenance. On the other hand, the opening 451*b* is connected to the branch 57*b* of the tube 57 to discharge the air in the ejection space S1 in the humidifying maintenance.

In addition to the above, below the plate-shaped component 410 on the profile of the head 10 in the main scanning direction, plate-shaped guide members 462*a* and 462*b* are fixed as first and second guides to fulfill the same function as the horizontal portions 62*a* and 62*b* above. These guide members 462*a* and 462*b* are substantially as wide as the ejection surface 10*a* in the sub-scanning direction. Furthermore, the guide member 462*a* opposes one end portion of the cap 440 in the main scanning direction (i.e. a first region 440*a* which is a part of the lip 408) with a gap interposed therebetween, so as to define a supply opening 461*a*. The supply opening 461*a* is narrow and long in the sub-scanning direction. With this, the humidified air from the opening 451*a* is supplied from the supply opening 461*a* toward the entirety of the first region 440*a*. Furthermore, the guide member 462*b* opposes the other end portion of the cap 440 in the main scanning direction (i.e., a second region 440*b* which is a part of the lip 408) with a gap interposed therebetween, so as to define a discharging opening 461*b*. This discharging opening 461*b* is also narrow and long in the sub-scanning direction. This makes it possible to cause the air in the ejection space S1 to flow along the entirety of the second region 440*b* and then to be discharged.

Also in this third variation, in the humidifying maintenance, the humidified air supplied from the supply opening 461*a* flows, as indicated by arrows in FIG. 12, along the inner circumferential surface of the first region 440*a*, passes through the gap between the ejection surface 10*a* on which the plurality of ejection openings 14*a* are formed and the opposing surface 407*a*, flows along the inner circumferential surface of the second region 440*b*, and is eventually discharged through the discharging opening 461*b*. Such a humidifying passage is formed in the ejection space S1. This makes it possible to achieve the effects similar to those of the embodiment above. Furthermore, as shown in FIG. 12, the humidifying passage includes a passage which extends along the first boundary 465*a* which is a boundary between the first region 440*a* which is a part of the lip 408 of the cap 440 and the opposing member 407 and along the second boundary 465*b* which is a boundary between the second region 440*b* which is a part of the lip 408 and the opposing member 407. This makes it possible to supply moisture also to the ink remaining at the boundaries 465*a* and 465*b*, and hence the thickening of such residual ink is restrained. As a matter of course, the effects similar to those of the embodiment above are achieved.

Other variations will be described below. While in the embodiment and the variations above the pair of horizontal portions 62*a* and 62*b* as the first and second guides and the guide members 262*a* and 262*b*, 362*a*, 362*b*, 462*a* and 462*b* are provided to constitute the supply opening and the discharging opening, these components may be unnecessary. In this case, for example, the opening 51*a* is formed to be open toward the first region 40*a* as the supply opening, and the opening 51*b* is formed to be open toward the second region 40*b* and to be in proximity to the second region 40*b*. In other words, the supply opening and the discharging opening are provided to constitute a humidifying passage in which the humidified air flows along the inner circumferential surface of the first region 40*a*, 340*a*, 440*a*, passes through the gap between the ejection opening 14*a* and the opposing member 7, 307, 407, and flows along the inner circumferential surface of the second region 40*b*, 340*b*, 440*b*. Furthermore, the supply opening and the discharging opening may be formed on the ejection surface 10*a*. In this case, the supply opening and the discharging opening are preferably formed on the outer side of the region where the ejection openings 14*a* are formed on the ejection surface 10*a*, with respect to one direction (e.g., in the main scanning direction). In this regard, the supply opening is formed so that the humidified air is supplied toward the first region 40*a* whereas the discharging opening is formed so that the air in the ejection space S1 flows along the inner circumferential surface of the second region 40*b* and is then discharged.

The supply opening 61*a* is arranged to oppose a part of the first region 40*a*. The discharging opening 61*b* is arranged to oppose a part of the second region 40*b*. The supply opening 61*a* and the discharging opening 61*b* are therefore not required to extend along the inner circumferential surfaces of the first region 40*a* and the second region 40*b*. Furthermore, the first region and the second region of the cap 40, 340, 440 may be arranged to oppose each other in the horizontal directions that are orthogonal to the main scanning direction. In this case, both of the supply opening and the discharging opening are preferably disposed along the horizontal directions.

In addition to the above, while the embodiment above is arranged so that the capping operation starts first and then the humidifying maintenance operation starts after the sealed state is established, the capping operation and the humidifying maintenance operation may simultaneously start or the humidifying maintenance operation may start before the start of the capping operation. In other words, various arrangements may be used as long as the above-described humidifying passage is formed in the ejection space S1 separated from the external space S2.

The disclosed technology may be used not only for the above-described line-type apparatus but also for serial-type liquid ejection apparatuses. Furthermore, the technology may be used not only for printers but also facsimile machines, photocopiers, and liquid ejection apparatuses that perform recording by ejecting liquid other than ink. The recording medium is not limited to the sheet P, and various recordable media may be used.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus comprising:

a liquid ejection head having ejection openings for ejecting liquid;

a capping mechanism which causes an ejection space opposing the ejection openings to take either one of a sealed state in which the ejection space is separated from an external space or a non-sealed state in which the ejection space is connected to the external space, the capping mechanism including an annular component which surrounds the ejection space in the sealed state and an opposing member which opposes the ejection openings with the ejection space interposed therebetween;

a mechanism for supplying humidified air, which generates humidified air and includes:

a humidified air supplying path defined at least partially by an inner wall surface;

a supply opening, which is an outlet for the humidified air supplying path, through which the humidified air is supplied from the humidified air supplying path into the ejection space separated from the external space by the capping mechanisms; and a discharging opening through which air is discharged from the ejection space; and a control unit which controls the capping mechanism so that the ejection space takes either one of the sealed state or the non-sealed state and controls the mechanism for supplying humidified air so that the humidified air is supplied to the ejection space in the sealed state through the supply opening and the humidified air is discharged through the discharging opening, the supply opening and the discharging opening being positioned to form a humidifying passage such that the humidified air having flown along an inner circumferential surface of a first region of the annular component passes through a gap between the ejection openings and the opposing member and flows along an inner circumferential surface of a second region of the annular component, which opposes the first region, wherein the supply opening is arranged to be open toward the first region of the annular component, wherein the discharging opening is disposed to be in proximity to the second region of the annular component, and wherein the inner wall surface, which at least partially defines the humidified air supplying path, extends toward the inner circumferential surface of the first region of the annular component when the ejection space is in the sealed state, such that at least a portion of the inner wall surface abuts the inner circumferential surface of the first region of the annular component to form the supply opening when the ejection space is in the sealed state.

2. The liquid ejection apparatus according to claim 1, wherein, the liquid ejection head has an ejection surface where the ejection openings are made through, the annular component separates, in the sealed state, the ejection space from the external space by abutting against either one of the ejection surface and the opposing member, and the humidifying passage includes a passage extending along a boundary between the annular component and said one of the ejection surface and the opposing member.

3. The liquid ejection apparatus according to claim 1, wherein, the supply opening extends in a circumferential direction of the annular component along the inner circumferential surface of the first region of the annular component.

4. The liquid ejection apparatus according to claim 3, wherein, in plan view, each of the liquid ejection head and the annular component is rectangular and arranged so that sides along one direction are longer than sides along a direction orthogonal to said one direction, and one of short sides of the annular component is a part of the first region.

5. The liquid ejection apparatus according to claim 1, wherein, the discharging opening extends in a circumferential direction of the annular component along the inner circumferential surface of the second region of the annular component.

6. The liquid ejection apparatus according to claim 5, wherein, in plan view, each of the liquid ejection head and the annular component is rectangular and arranged so that sides along one direction are longer than sides along a direction orthogonal to said one direction, and one of short sides of the annular component is a part of the second region.

7. The liquid ejection apparatus according to claim 1, wherein, the supply opening and the discharging opening are provided to sandwich the liquid ejection head, the annular component encloses the supply opening and the discharging opening in plan view and establishes the sealed state such that a leading end of the annular component abuts against the opposing member, and the humidifying passage includes a passage extending along a first boundary which is a boundary between the first region of the annular component and the opposing member and along a second boundary which is a boundary between the second region of the annular component and the opposing member.

8. The liquid ejection apparatus according to claim 1, further comprising:

a first guide which constitutes the supply opening which is open toward the inner circumferential surface of the first region so that the humidified air is supplied toward the inner circumferential surface of the first region; and a second guide which constitutes the discharging opening which is open toward the inner circumferential surface of the second region so that air around the inner circumferential surface of the second region is discharged.

9. The liquid ejection apparatus according to claim 1, wherein, the mechanism for supplying humidified air includes:

a return passage which has the supply opening at one end and the discharging opening at the other end; and a humidification device which humidifies air in the return passage so as to generate the humidified air.

10. The liquid ejection apparatus according to claim 1, wherein the at least a portion of the inner wall surface, which abuts the inner circumferential surface of the first region of the annular component to form the supply opening when the ejection space is in the sealed state, is parallel to an ejection surface in which the ejection openings are formed.

* * * * *